United States Patent [19]

Lenglet

[11] 4,129,160

[45] Dec. 12, 1978

[54] NOZZLE FOR BLOWING MOLDS OR CORES FOR SAND CASTING

[75] Inventor: Henry Lenglet, Les Clayes sous Bois, France

[73] Assignee: Regie Nationale des Usines Renault, Boulogne-Billancourt, France

[21] Appl. No.: 844,172

[22] Filed: Oct. 21, 1977

[30] Foreign Application Priority Data

Nov. 9, 1976 [FR] France ..... 76 33686

[51] Int. Cl.[2] ..... B65D 25/40; B22C 15/24

[52] U.S. Cl. ..... 141/388; 141/367; 164/200; 222/568

[58] Field of Search ..... 164/200, 201, 292; 285/9 R, 9 M, 318; 85/32 CS, 1 F; 151/14 CS; 239/587; 222/568; 425/404; 141/311, 392, 388, 387

[56] References Cited

U.S. PATENT DOCUMENTS

| | | | |
|---|---|---|---|
| 2,556,627 | 6/1951 | Miksis | 222/568 |
| 3,987,842 | 10/1976 | Chamdry | 164/200 |

*Primary Examiner*—Francis S. Husar
*Assistant Examiner*—John S. Brown
*Attorney, Agent, or Firm*—Oblon, Fisher, Spivak, McClelland & Maier

[57] ABSTRACT

Nozzle for blowing molds or cores for sand casting where the sand is injected under pressure into the core boxes. The injection orifices in the plate of the machine for blowing sand under pressure into the core boxes are threaded holes onto which are screwed closely coiled spiral springs forming injection conduits, the injection nozzles being screwed onto the said springs by means of threaded holes of suitable diameter and thread.

7 Claims, 1 Drawing Figure

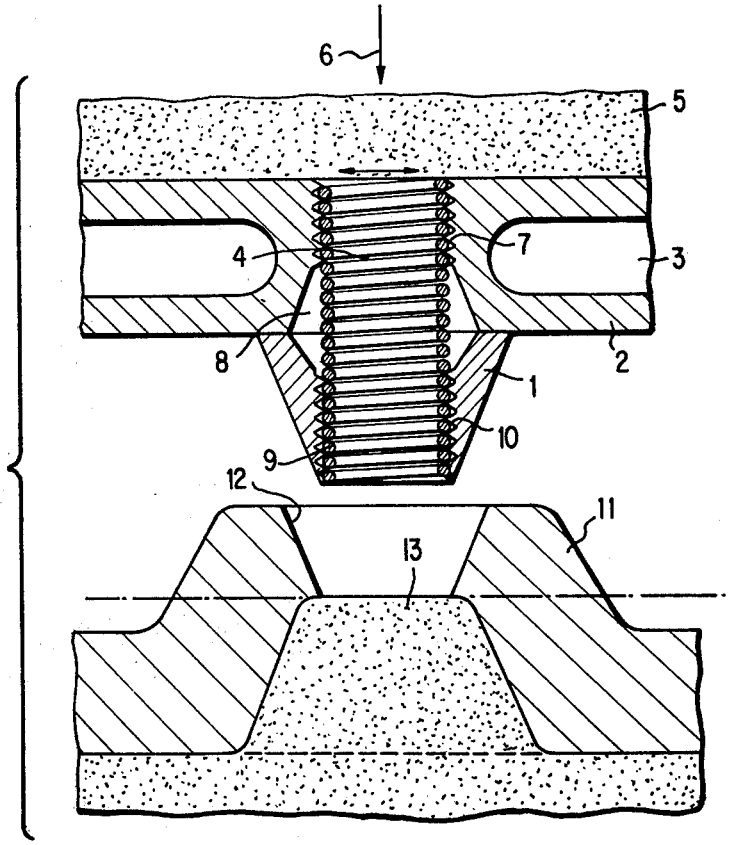
6
5
4
7
3
8
2
1
10
9
12
11
13

NOZZLE FOR BLOWING MOLDS OR CORES FOR SAND CASTING

BACKGROUND OF THE INVENTION

1. Field of the Invention

The present invention is directed to the fabrication of cores in casting sand injected under pressure and concerns blowing nozzles of the type utilized in casting for the fabrication of molds and cores of sand, by blowing the sand into a shaping device called a "core box".

2. Description of the Prior Art

Obtaining sand molds of somewhat difficult shape or relatively large volume implies a shaping device in which the sand is supplied to several portions of its surface by simultaneous feed through several nozzles.

The problem then arises of coincidence of the injector nozzles and the hot box orifices, particularly on account of certain factors such as temperature changes, machining tolerances, etc . . . which, if not resolved, leads to poor sealing between these two elements, with deterioration and rapid wear of the core box.

SUMMARY OF THE INVENTION

The object of the present invention is to enable easy and exact centering of the nozzles in the shaped orifices without entailing the expense of precisely machining these elements, as well as to allow a certain latitude in lateral displacement of the latter, thus eliminating the strains that could arise between the sand-feeding arrangement and the core box.

BRIEF DESCRIPTION OF THE DRAWING

Various other objects, features and attendant advantages of the present invention will be more fully appreciated as the same becomes better understood from the following detailed description when considered in connection with the accompanying drawing in which like reference characters designate like or corresponding parts throughout the view, and wherein:

The FIGURE shows a cross-section of a portion of the present invention.

DETAILED DESCRIPTION OF THE PREFERRED EMBODIMENT

The invention will be described by way of a non-restrictive example with the help of the attached FIGURE which shows the sand-feeding device, the sand-blowing nozzle and a portion of the hot box.

The attachment of the nozzle 1 to the plate 2 of a straightforward sand-injecting device is shown in the attached FIGURE. The plate 2, which can have a circulating-liquid cooling system 3, in the case where the core boxes are of the type called "hot box", is traversed at right angles to the nozzle 1 by a passage 4 intended for the flow of the sandy mixture 5, under the action of a pressure indicated by arrow 6 in the sand-injecting machine.

The passage 4 is threaded inside while its lower part has a conical enlargement 8. The nozzle 1, of generally conical shape and can be made of a fluorinated elastomer of the type marketed by Dupont de Nemours under the tradename VITON, has a central boring 10 likewise threaded with the same pitch and diameter as those of the passage 4, having a conical enlargement 8 at its upper end also.

The nozzle 1 is joined to the plate 2 by means of a helical spring 9 with contacting turns of diameter and pitch corresponding to those of the passage 4 and of the boring 10 into which it is screwed.

During the injection phase of the sandy material 5 into the core box 11, the plate 2 adjoins the latter in such a way that the cores of the nozzle 1 coincide with the openings 12 in the core box. But, for the reasons given above, it may happen that some nozzles are not exactly centered in the corresponding openings.

In this case, a recentering could be effected automatically when bringing the two complementary elements into contact, thanks to a translatory movement of the nozzle 1 along the bottom face of the plate 2, permitted by the flexibility of the spring 9 and the conicity of conical enlargement 8 of the lower end of the opening 4 and of the upper part of the boring in nozzle 1.

Also to be noted is the good resistance of the spring 9 to wear, inherent in its material, and the fact that the roughness of its coils tends to retain the sandy plug left in the spring, which limits the dropping of sand when retracting plate 2 after an injection. Thus there is realized a particularly economical and effective connection of the sand-injecting nozzle.

In the case of hot core boxes, particularly where good cooling is desired for the hole 4 for the passage of sand, in order to avoid premature clogging of sand in the nozzle and distortion of the latter, the spring 9 has the advantage of being in good permanent direct contact, via the thread 7, with the cooled plate 2, while the contact with the box 11, source of the heating, is indirect and intermittent via the surfaces 13 and the nozzle 1. One thus avoids any distortion of the nozzle, the problem with the standard or conventional solutions where a seams between nozzle and cooled plate reduces the cooling and requires individual cooling loops in each nozzle.

Obviously numerous modifications and variations of the present invention are possible in lihgt of the above teachings. It is therefore to be understood that within the scope of the appended claims, the invention may be practiced otherwise than as specifically described herein.

What is claimed as new and desired to be secured by Letters Patent of the United States is:

1. A nozzle for blowing molds for sand casting in sand core boxes which comprises:

a filling plate, including a threaded passage of predetermined pitch and diameter provided therein, for injecting sand into such sand core boxes, said nozzle being secured to said filling plate and also including a threaded passage provided therein having the same pitch and diameter as said threaded passage of said filling plate; and, a helical spring, with contacting turns of diameter and pitch corresponding to that of said threaded passage of said filling plate and said nozzle, screwed into said threaded passage of said filling plate and said nozzle so as to form a flexible coupling therebetween.

2. A nozzle as set forth in claim 1, which further comprises:

contiguous and conical enlargements provided in a lower portion of said filling plate and an upper portion of said helical spring so as to provide an automatic recentering of said nozzle with respect to an opening of such sand core boxes during a sand injection phase.

3. A nozzle as set forth in claim 2 which further comprises:

means for injecting sand through said filling plate threaded passage and said nozzle threaded passage into such sand core boxes.

4. A nozzle as set forth in claim 2 which further comprises:

means for circulating cooling liquid disposed within said filling plate.

5. A nozzle as set forth in claim 1 which further comprises:

means for injecting sand through said filling plate threaded passage and said nozzle threaded passage into such sand core boxes.

6. A nozzle as set forth in claim 1 which further comprises:

means for circulating cooling liquid disposed within said filling plate.

7. A nozzle as set forth in claim 1 wherein:

said nozzle is conically shaped and comprises a fluorinated elastomer.

* * * * *